US005381974A

United States Patent [19]

Gygi

[11] Patent Number: 5,381,974

[45] Date of Patent: Jan. 17, 1995

[54] CRUSHER

[76] Inventor: Martin H. Gygi, Stümelweg, CH-8914 Aeugst am Albis, Switzerland

[21] Appl. No.: 25,958

[22] Filed: Mar. 3, 1993

[30] Foreign Application Priority Data

Mar. 25, 1992 [CH] Switzerland ..... 945/92
Nov. 6, 1992 [EP] European Pat. Off. ..... 92119007

[51] Int. Cl.[6] ..... B02C 19/00
[52] U.S. Cl. ..... 241/188.1; 241/275
[58] Field of Search ..... 241/188.1, 186.2, 189.1, 241/275

[56] References Cited

U.S. PATENT DOCUMENTS

| | | | |
|---|---|---|---|
| 1,212,418 | 1/1917 | Sturtevant | 241/188.1 X |
| 3,150,838 | 9/1964 | Adams | 241/275 |
| 3,834,631 | 9/1974 | King | 241/275 X |
| 4,373,679 | 2/1983 | Kawano et al. | 241/275 |
| 4,579,290 | 4/1986 | Terrenzio | 241/275 |
| 4,637,561 | 1/1987 | Edberg | 241/188.1 |
| 4,819,886 | 4/1989 | Lambert | 241/186.1 |
| 4,844,354 | 7/1989 | Watajima | 241/275 X |
| 4,848,677 | 7/1989 | Rayner | 241/189.1 X |
| 5,145,118 | 9/1992 | Canada | 241/275 X |

FOREIGN PATENT DOCUMENTS

| | | | |
|---|---|---|---|
| 567219 | 12/1958 | Canada | 241/275 |
| 0261913 | 3/1988 | European Pat. Off. . | |
| 337137 | 10/1989 | European Pat. Off. | 241/189.1 |
| 0477812 | 4/1992 | European Pat. Off. . | |
| 2811376 | 9/1979 | Germany . | |
| 8810234 | 9/1988 | Germany . | |
| 3935882 | 5/1991 | Germany . | |
| 1431833 | 10/1988 | U.S.S.R. | 241/275 |

*Primary Examiner*—Mark Rosenbaum
*Assistant Examiner*—Frances Han
*Attorney, Agent, or Firm*—Ladas & Parry

[57] ABSTRACT

The crusher contains rotating hammers running on a circular path. The material to be crushed reaches this annular crushing zone via a distributing plate located above the hammers. In the crushing zone the material is hit by the hammers and broken. Fragments are thereby ejected tangentially into an impact zone, where they are received by impact plates. This causes further fragmentation. In this way, the material distributed over the whole circumference is subjected twice to a hard blow. This leads to an increased throughput at small crusher size and optimum crushing efficiency.

17 Claims, 4 Drawing Sheets

CRUSHER

BACKGROUND OF THE INVENTION

1. Field of the Invention

The invention relates to a crusher for crushing material. Such crushers are known as a first step in a milling process. They break raw material into pieces of a defined size, which are then fed to a mill where they are milled. Crushers are also used for material that is not to be milled further but to be used directly, such as in the production of gravel.

2. Description of the Prior Art

Known crushers or breakers have the disadvantage of a comparatively poor material throughput. Often it is necessary to recycle material that was not sufficiently crushed in a first pass through the crusher. Such a crusher is e.g. described in EP—0 372 149.

SUMMARY OF THE INVENTION

Therefore it is an object of the invention to provide a crusher with a large throughput.

It is a further object of the invention to provide a crusher where parts exposed to wear are used optimally.

Now, in order to implement these and still further objects of the invention, which will become more readily apparent as the description proceeds, the crusher comprises a set of rotating crushing hammers arranged in a housing. The crushing hammers are rotating along a substantially circular path. An impact zone is located radially outward from said crushing hammers. A plurality of impact surfaces are arranged in this impact zone for receiving and further crushing material hit by the hammers. For this purpose, the impact surfaces are positioned to be approximately perpendicular to the tangential direction of movement of the hammers. Furthermore, stopper means are provided for preventing large pieces of material from falling through the zone of the hammers without being engaged by them.

Preferably, the stopper means are formed by a shoulder located directly below the hammers. Material falling through the crushing zone of the hammers without being hit is stopped by this shoulder and engaged by a next hammer.

The crusher can be used as an individual unit or as a part of a milling plant, i.e. in combination with a mill.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
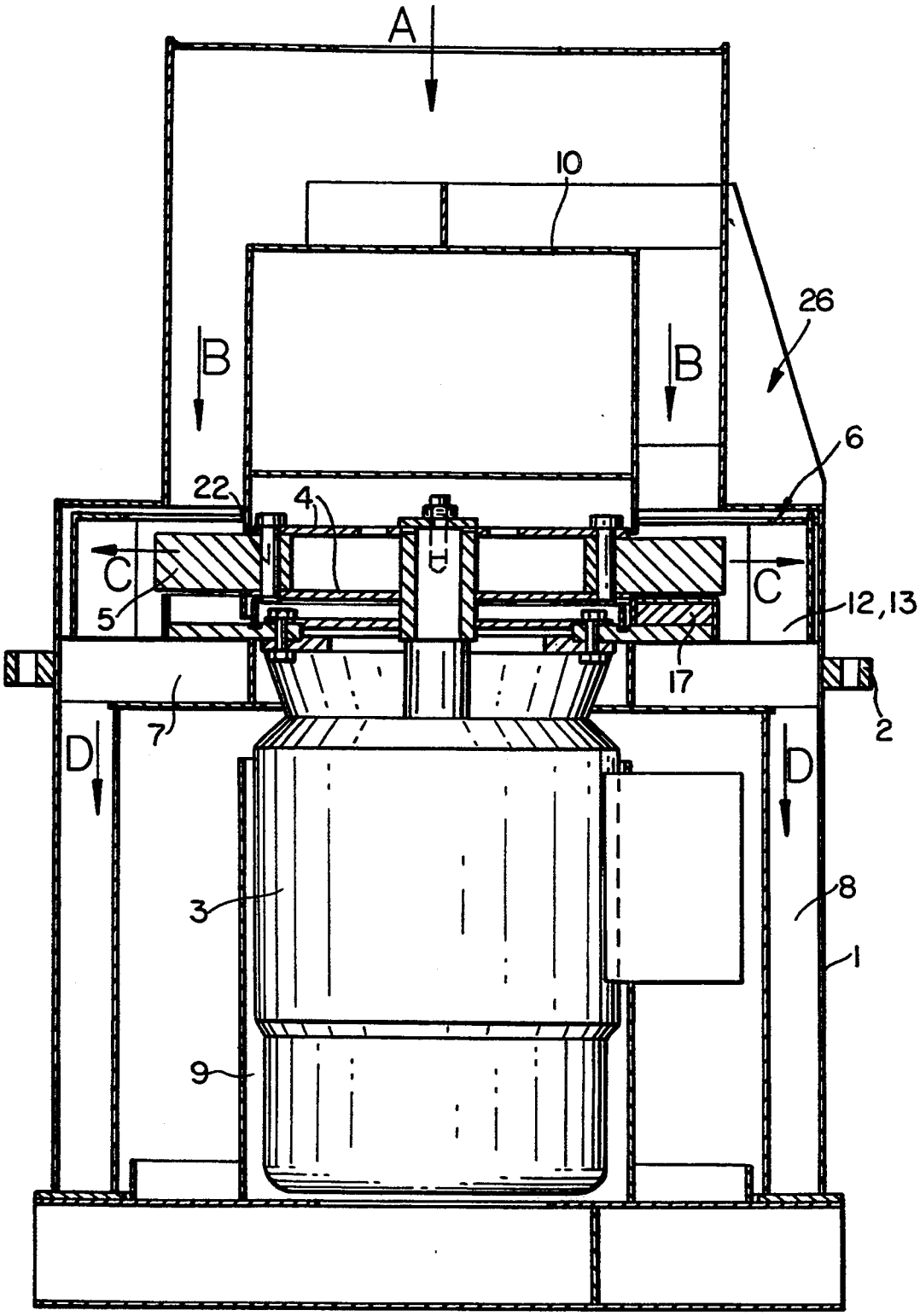
FIG. 1 is a sectional drawing of a first embodiment of the crusher.

FIG. 1 shows a total view of a first embodiment of the crusher for explaining its basic setup. A cylindrical housing 1 is anchored in a foundation (not shown) by means of circumferentially arranged holders 2. A driving motor 3 is centrally arranged on radial bars 7. Two mounting plates 4 are fixed to the axis of this electromotor 3 providing a holder for the crushing hammers 5. Rectangular steel bars are provided as rotating crushing hammers 5, each of which is pivotally mounted in the plates 4 by means of a bolt 22. Preferably, the crushing hammers 5 are cast from two different alloys of steel. In a rear part covered by the plates 4 they consist of a mechanically workable, low-alloy steel. Their forward part is made from a tough, high-alloy steel.

A distributing table 10 is arranged above the hammers, from which the material to be crushed falls distributed over a defined circumference into the annular breaking zone of the hammers. The distributing table 10 can be adjustable in height for adapting the falling speed of the material to the speed of rotation of the hammers, such that all pieces of material are hit. An impact zone for receiving material hit and thrown off by the hammers is arranged radially outside the crushing hammers 5. In the embodiment according to FIG. 1 this impact zone is an annular insert 6 arranged in the housing and comprising approximately radially extending impact plates 12, 13 for receiving the material. Their function will be explained in more detail in the FIGS. 2–4. The insert 6 rests on the radial bars 7. An annular outlet channel 8 for crushed material is located outside the motor 3. A fan (not shown) is arranged below the motor. Air guiding means 9 are provided along the motor 3 for guiding the cooling air along the cooling ribs of the motor and separating it from the air flowing back. The flow of the material through the crusher is indicated by arrows.

Figure 4:
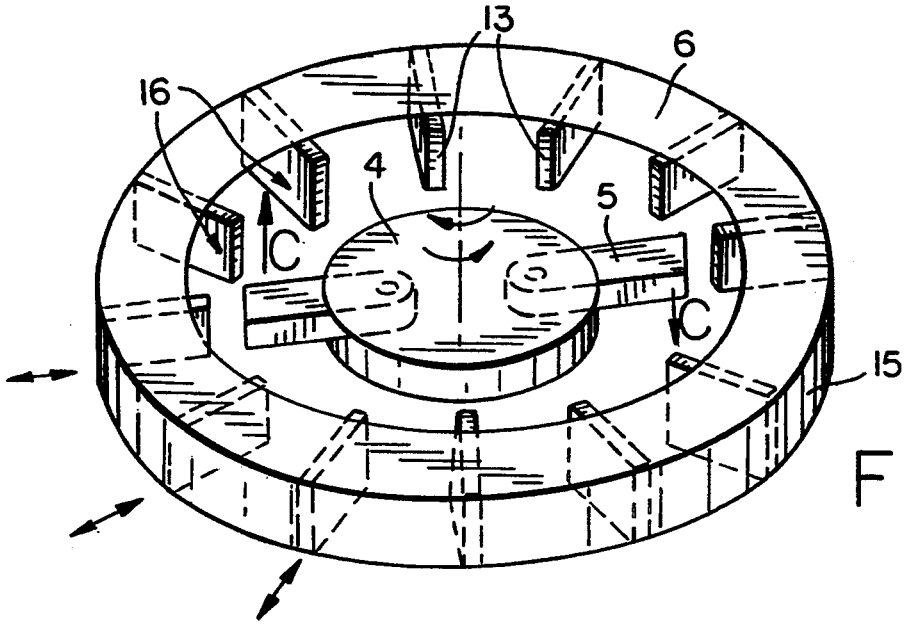
FIG. 4 s a second embodiment of the insert.

The working of the crusher is now shown by referring to FIGS. 1 and 4. As indicated by arrow A the material to be crushed, such as clinker, is fed centrally and forms a cone of material on the distributing table 10. Subsequently material fed to the crusher runs down along this cone and is thereby distributed along the circumference of the table 10. The distributing table 10 is protected from wear by means of this cone of material. The material then falls down along arrows B into the annular crushing zone, where the crushing hammers 5 are rotating. The speed of rotation and/or the height of the hammers can be chosen such that each piece of material falling through the crushing zone is hit and crushed by a hammer. A shoulder 17 is located below the crushing hammers for preventing pieces of material from falling through between two hammers 5 without being hit. A protective layer of such material lying on the shoulder 17 protects it from wear. Further material comes to a rest thereon and will be engaged by a next hammer passing over it.

We now follow the path of an individual piece of material to be crushed: The piece falling from the table 10 is hit by one of the hammers tangentially somewhere in the crushing zone. By this impact the piece is broken into fragments, which are e.g. thrown off approximately along arrow C (cf. FIG. 4) according to the theorem of momentum. If this impact is assumed to be completely inelastic and if the piece is hit by a flat side of the hammer, the fragments have a velocity equal to the tangential velocity of the hammers.

Substantially radially arranged impact plates 12, 13 are arranged standing outside the path of the hammers (cf. FIG. 4). These plates are hit by the fragments with their tangential velocity. By hitting these plates of hardened steel, the fragments are broken further into smaller pieces, which then fall down into the annular outlet channel 8 (see arrow D of FIG. 8) because of gravitation. In this way the impact plates remain free of material depositions and always offer a hard impact surface.

The crushing of the material is therefore carried out in two, defined steps, wherein the flow of the material through the crusher follows a hollow cylindric path. The large surface of processing that is achieved in this way allows a high throughput at a high crushing efficiency.

Figure 2:
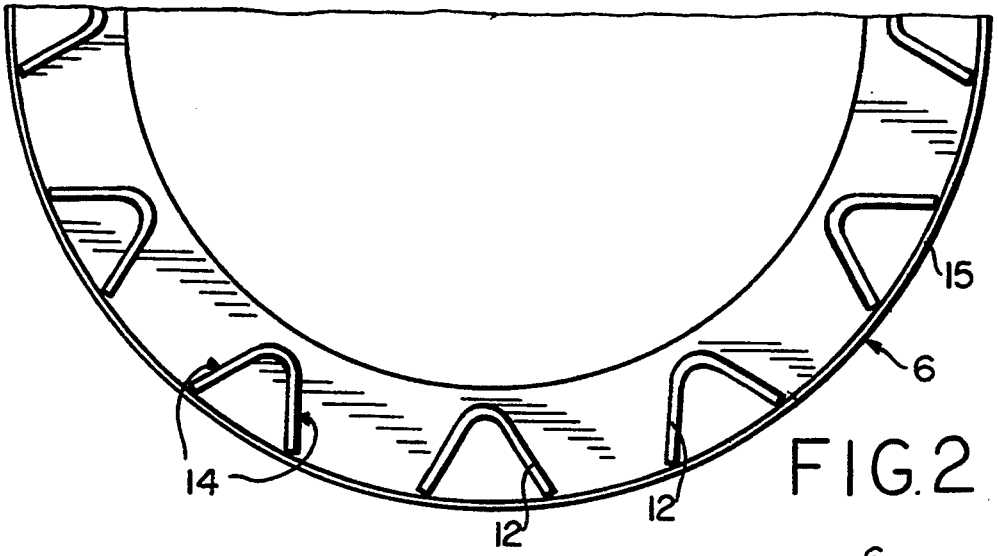
FIG. 2 shows a bottom view of a first embodiment of an insert with impact plates.
Figure 3:
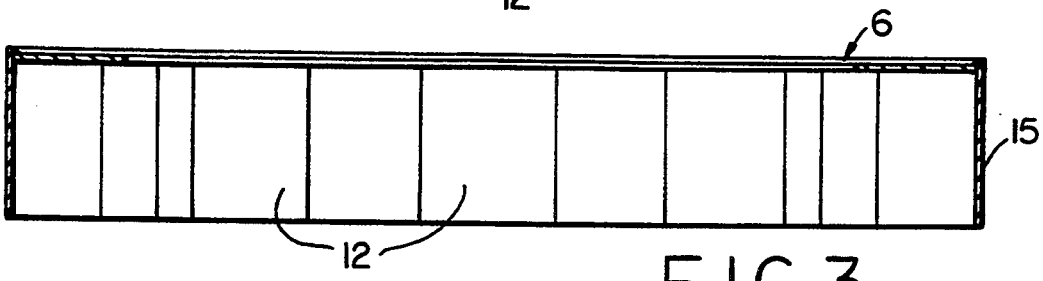
FIG. 3 shows a side view of this insert.

The insert 6 of the impact plates is shown in different embodiments in FIGS. 2 to 4. It comprises upright impact plates 12, 13, which are e.g. arranged at angular distances of 30° over the circumference. An optimal orientation of the impact plates is reached when the fragments hit the impact surfaces approximately perpendicularly. For this purpose, the impact plates 12 according to FIG. 2 are angled, such that their impact surfaces 14 are oriented approximately perpendicular to the path of the arriving fragments. Since the crusher is operated in both directions of rotation, as it will be explained below, impact surfaces 14 are provided on both sides of the angled plates 12.

FIG. 4 shows another embodiment with radially arranged impact plates 13. Here, the fragments arrive at the impact surfaces 16 under an angle that deviates somewhat from 90°. Since the impact can be assumed to be inelastic, its efficiency not substantially decreased. Also in this case the impact plates 13 are arranged at a mutual angular distance (of 30° ) such that direct impact of fragments on the exterior wall 15 of the inset 6 is avoided. The symmetric arrangement of the impact plates in respect to the rotational direction of the hammers 5 allows again a reversal of the rotational direction, as indicated by arched arrows in FIG. 4. Further, the impact plates of this embodiment are displaceable in radial direction for optimizing the crusher characteristics. A distance of 30–40 mm between the outer edge of the crushing hammers and the impact plates has been found to be advantageous.

Figure 6:
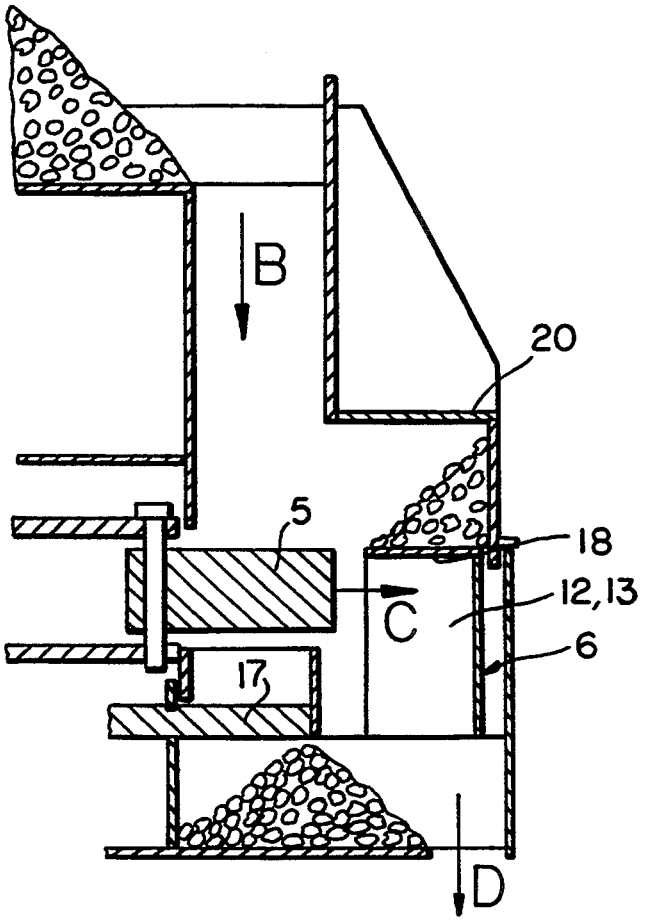
FIG. 6 shows a somewhat modified embodiment of the crusher in a partially axial sectional view, and FIG. 7 a further, preferred embodiment of the crusher.

FIG. 6 shows a modified embodiment of the crusher of FIG. 1. For reducing the wear of the housing caused by fragments that are scattered up into an area immediately above the insert 6, the distance between the horizontal wall 20 of the housing and the crushing zone has been increased. For preventing pieces of material from falling down between the impact plates without passing through the crushing zone, a cover 18 is provided above the impact plates approximately at the height of the hammers 5. Material arriving on this cover falls down and inward over an incline of material towards the breaking zone. If its size exceeds a minimum particle size, it is then hit by the hammers 5. This minimum particle size is defined by the radial distance between the cover 18 or the impact plates and the hammers 5. Preferably, the vertical position of the cover 18 in respect to the plane of rotation of the hammers 5 can be adjusted, e.g. by lifting the insert 6.

Figure 7:
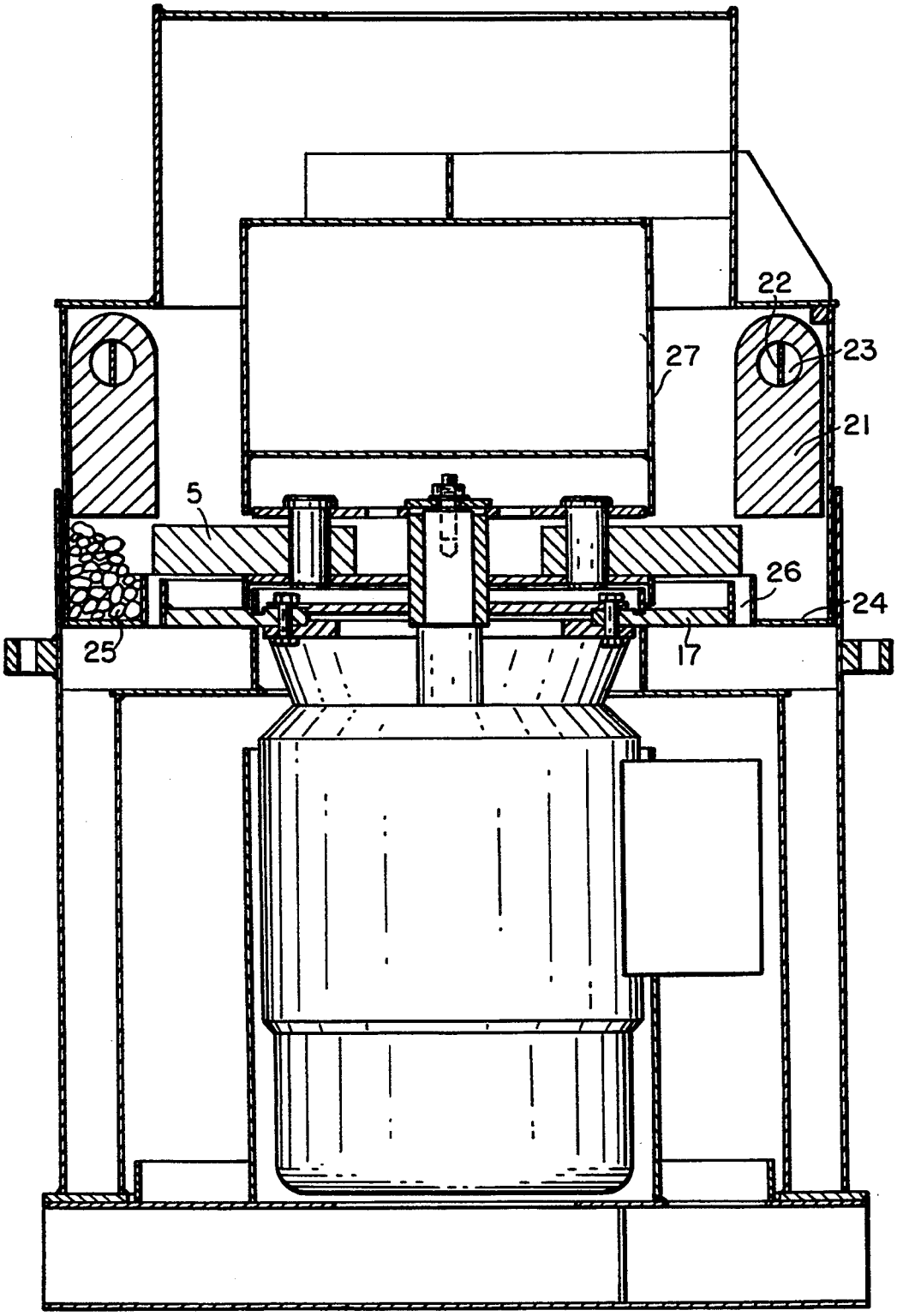

FIG. 7 shows a preferred embodiment of the crusher. In this example, the impact plates a formed by a plurality of hammers 21, which are arranged stationary in the impact zone. They are forming the impact surfaces, which are hit by the fragments from the crushing hammers 5.

These stationary hammers 21 are the same parts as used for the rotating hammers. This reduces the number of different parts in the crusher. It also has the advantage that crushing hammers worn from the use in the rotor can still be used as impact plates. This reduces the costs of operation of the crusher considerably.

The embodiment of FIG. 7 contains approximately twelve stationary crushing hammers 21 at regular distances. They are hanging from plate-shaped holding members 22, which are led through the mounting holes 23 of the hammers.

The stationary hammers 21 forming the impact surfaces are arranged radially outside of and above the rotating crusher hammers 5. The reason for this arrangement lies in the fact that, depending on working conditions (rotational speed and wear of the hammers, falling speed of the material, etc.), a large part of the fragments ejected by the rotating hammers 5 can have an upward directed component of velocity. Therefore, it can be useful to arrange the impact surfaces (i.e. the plates 12, 13 or the stationary hammers 21) at least partially above the rotating hammers 5. To achieve a homogeneous wear of these elements, they can also be mounted displaceably in vertical direction. Thereby it also becomes possible to adapt the position of the impact plates (or stationary hammers, respectively) to the current working conditions.

In the embodiment according to FIG. 7 a shoulder 24 is positioned below the impact zone. It forms a barrier which prevents material ejected horizontally from the crushing zone from falling down. The deposited material 25 lying on this shoulder protects the wall of the housing from wear.

In the preferred embodiment of FIG. 7 the maximum size of the crushed material is defined by the width of the gap 26 that is formed between the shoulders 17 and 24.

The use of old, worn hammers is not only limited to the impact zone. Such hammers can also be arranged in other parts of the crusher that are exposed to wear. Many fragments of material bouncing off the impact zone are e.g. hitting the inner wall 27. For protecting this wall, it can be clad with or replaced by old hammers.

Furthermore, old hammers can also be used for protecting or replacing other parts of the walls.

As it has been mentioned above, the rotating crushing hammers 5 are exposed to considerable wear, even if they are made from an abrasive-resistent alloy. On hammers with a rectangular cross-section it can be observed that especially the forward, upper edge is worn off quickly.

Figure 5:
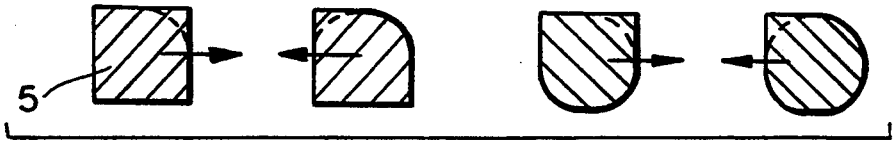
FIG. 5 shows four phases in the wear of a hammer in sectional view.

FIG. 5 schematically illustrates the corresponding wear of a crushing hammer 5 shown in cross section in four phases of its operational life. At first, as shown in the two leftmost drawings, both upper edges of the hammer are worn down by reversing the rotational direction after a certain operation time. Then the hammer is removed from its holding, turned upside down, and mounted again. Now, the two remaining edges of the hammers are worn down as well.

The wear occurs homogeneously over the whole length of each crushing hammer with exception of the part between the two plates 4. For exchanging or turning the hammer, only the bolt 22 must be removed.

In this way, the crushing hammers can be used optimally. Therefore, the operation of the inventive crusher is much cheaper than the operation of conventional crushers. A further advantage of the crusher is its compact design compared to its throughput, which is made possible by the fact that material is processed over the whole circumference of the device.

The crusher consists essentially of two parts. A base part 1 with the driving motor and the rotating hammers is anchored in a foundation. An upper input part 26, as well as the annular insert 6 and/or the mounting for the stationary hammers 21 are resting removably on the base part. The crushing hammers 5 can therefore easily be reached by lifting the upper part 26 of the crusher, which simplifies the periodic replacement and maintenance of the crushing hammers 5.

While there are shown and described present preferred embodiments of the invention, it is to be distinctly understood that the invention is not limited thereto, but may be otherwise variously embodied and practiced within the scope of the following claims.

I claim:

1. A crusher for crushing material comprising rotating crushing hammers in a housing, said rotating crushing hammers being driven for rotating along a substantially circular path in a direction of rotation, said path defining an annular crushing zone for receipt of falling material to be crushed, an impact zone comprising a plurality of circumferentially distributed impact surfaces for receiving pieces of said material hit by said rotating crushing hammers, and a stationary, annular shoulder means positioned immediately below said crushing zone for collecting pieces of material otherwise falling through said crushing zone without being engaged by one of said rotating hammers and retaining said collected pieces in said crushing zone until engaged by one of said hammers, said annular shoulder means having a shoulder with a continuous surface which blocks sufficient space underlying said annular crushing zone such that the material must pass radially outward of the shoulder to exit the crusher.

2. The crusher of claim 1 comprising a distributing table arranged above said annular crushing zone, from which distributing table said material is falling into said crushing zone.

3. The crusher of claim 1, wherein said impact surfaces are located at least partially above said crushing zone and can be adjusted vertically.

4. The crusher of claim 1, wherein said impact zone contains an annular insert and impact plates mounted on said annular insert, the surfaces of said impact plates providing said impact surfaces.

5. The crusher of claim 1, wherein said rotating crushing hammers are arranged on a mounting, which mounting is attached directly to an axis of a driving motor.

6. The crusher of claim 1, wherein a cylindrical receiving zone for crushed material is located below said crushing zone, said receiving zone enclosing a driving motor.

7. The crusher of claim 1, wherein said rotating crushing hammers are exchangeably mounted and wherein each crushing hammer can be mounted in at least two orientations.

8. The crusher of claim 1, wherein said rotating crushing hammers are pieces of casting with a forward part of high-alloyed, abrasive-proof steel and a backward mounting-part of workable steel.

9. The crusher of claim 1, comprising an annular cover above said impact zone for preventing pieces of said material from falling through said impact zone without passing through said crushing zone.

10. The crusher of claim 1, wherein walls of said crusher are at least partially covered by stationary mounted protecting elements for protecting said walls from an impact of pieces of said material, wherein crushing hammers are used as said protecting elements.

11. The crusher of claim 1, comprising barrier forming means spaced radially outward from said shoulder means and cooperating with the shoulder means for defining an outlet gap between said shoulder means and said barrier forming means and for preventing material from exiting the crusher other than through the gap.

12. The crusher of claim 1, wherein said direction of rotation of said rotating crushing hammers is reversible.

13. The crusher of claim 12, wherein said impact surfaces are positioned such that for both directions of rotation of said rotating crushing hammers material hit by said rotating crushing hammers impacts on at least one of said impact surfaces.

14. The crusher of claim 1, comprising stationary crushing hammers, the surfaces of said stationary crushing hammers providing said impact surfaces, said stationary crushing hammers having the same size and shape as said rotating crushing hammers such that the stationary crushing hammers and rotating crushing hammers can be interchanged.

15. The crusher of claim 14, wherein said stationary crushing hammers are located at least partially above said crushing zone.

16. The crusher of claim 1, wherein said hammers are mounted in circumferentially spaced apart and radially outwardly extending relationship on a rotating support means.

17. The crusher of claim 16, wherein said rotating support means rotates about an axis of rotation, said annular crushing zone surrounds said axis and has, relative to said axis, inner and outer circumferential edges, and said continuous surface of said annular shoulder extends from beneath said inner edge towards and almost to said outer edge of said crushing zone.

* * * * *